US006181058B1

(12) United States Patent
Lee

(10) Patent No.: US 6,181,058 B1
(45) Date of Patent: Jan. 30, 2001

(54) CATHODE IN ELECTRON TUBE WITH ACTINOID METAL(S) OR COMPOUND(S) THEREOF

(75) Inventor: Gyeong Sang Lee, Kyungsangbuk-do (KR)

(73) Assignee: LG Electronics, Inc., Seoul (KR)

( * ) Notice: Under 35 U.S.C. 154(b), the term of this patent shall be extended for 0 days.

(21) Appl. No.: 09/190,187

(22) Filed: Nov. 12, 1998

(30) Foreign Application Priority Data

Nov. 13, 1997 (KR) ..... 97-59829

(51) Int. Cl.[7] ..... H01J 1/14; H01J 19/06
(52) U.S. Cl. ..... 313/346 R; 313/346 DC
(58) Field of Search ..... 313/346 R, 340, 313/337, 310, 270, 346 DC

(56) References Cited

PUBLICATIONS

Patent Abstract of Japan, A 59020941, Feb. 02, 1984.
Patent Abstract of Japan, A 62088240, Apr. 22, 1987.
Patent Abstract of Japan, A 62090819, Apr. 25, 1987.
Patent Abstract of Japan, A 62088239, Apr. 22, 1987.
Patent Abstract of Japan, A 62022347, Jan. 30, 1987.

*Primary Examiner*—Nimeshkumar D. Patel
*Assistant Examiner*—Kevin Quarterman
(74) *Attorney, Agent, or Firm*—Birch, Stewart, Kolasch & Birch, LLP

(57) ABSTRACT

Cathode in an electron tube, is disclosed, including an actinoid metal or actinoid metal compound added to either a thermion emission material layer or a base metal, or formed between the thermion emission material layer and the base metal, whereby improving an electron emission characteristic of the cathode, significantly.

39 Claims, 7 Drawing Sheets

Date : Jun 12 1996 3:08pm
Scanning Rate : 10.0 C/min
Sample Wt : 15.176 mg path : a:\
File : SAMPLE1 S. J. LEE Perkin-Elmer TGA7

CATHODE IN ELECTRON TUBE WITH ACTINOID METAL(S) OR COMPOUND(S) THEREOF

BACKGROUND OF THE INVENTION

1. Field of the Invention

The present invention relates to an electron tube, such as a cathode ray tube for a TV receiver, and more particularly, to a cathode in an electron tube, of which electron emission performance is improved.

2. Background of the Related Art

To keep pace with recent development of large sized, highly defined, and multimedia images, a cathode with an improved electron emission concentration is required for use in a cathode ray tube.

Referring to FIG. 1, a related art cathode is provided with a thermion emission material layer 3 of an oxide of an alkaline earth metal containing at least barium Ba formed on a base metal 1 of nickel as a main composition added with a small amount of reducing element, such as silicon Si or Mg. And, there is a heater 4 is fitted in a cylindrical sleeve 2, for heating the thermion emission material layer 3, to emit thermions.

The aforementioned related art cathode is fabricated by the following process.

A suspension of an alkaline earth metal carbonate is coated on the base metal 1 and heated by the heater 4 in a vacuum, to convert the alkaline earth metal carbonate into the alkaline earth metal oxide. Then, a portion of the alkaline earth metal oxide is reduced at 900~1000° C. so that the alkaline earth metal oxide is activated to have a semiconductor property, forming the thermion emission material layer 3 on the base metal 1. In above activation, the reducing element, such as silicon or magnesium contained in the base metal 1 is diffused to an interface of the alkaline earth metal oxide and the base metal 1 and makes a chemical reaction with the alkaline earth metal oxide. This alters the thermion emission material layer 3 into an oxygen depleted type semiconductor in which a portion of the alkaline earth metal oxide is reduced, which has an emission current of 0.5~0.8 $A/cm^2$ under a regular operation temperature.

However, a high current can not be obtained from the related art cathode during a lifetime of the related art cathode because of a highly resistant layer of an interface layer formed of a reaction oxide between the thermion emission material layer 3 and the base metal 1, which impedes current flow and diffusion of the reducing element in the base metal into the thermion emission material layer 3 that suppresses emission of adequate amount of barium Ba. Japanese laid open patent No. 59-20941 discloses a cathode provided with a thin base metal for obtaining a quick action of the cathode and a base metal containing lanthanum La in forms of $LaNi_5$ and $La_2O_3$ in purposes for preventing dry up of reducing elements and preventing weakening of the base metal during the lifetime of the cathode. A. van Oostrom discloses a cathode formed by press molding a mixed powder of tungsten W and $Ba_3Sc_4O_9$ in the Application of Surface Science 2(1979), p173–186 of the USA. German laid open patent No. 2626700 discloses a thermion emission material for use in a high pressure discharge lamp, of alkaline earth metal oxide, such as a mixture of BaO and tungsten oxide, or molybdenum and a rare earth metal oxide. U.K. patent No. 1592520 discloses a thermion emission material layer for use in a discharge lamp, of BeO and $Y_2O_3$ added with $Ba_{2-x}Sr_xCaWO_v$($x$=0–0.5). For an improvement of a thermion emission characteristic, Korea patent application No. 86-5652 discloses, as a first embodiment, a cathode having a base metal 1 of nickel as a main composition, and a thermion emission material layer 3 of an alkaline earth metal oxide containing at least barium Ba as a main composition added with 0.1–20 wt % of a rare earth metal oxide or 0.05–15 wt % of rare earth metal, formed on the base metal 1, as a second embodiment, a cathode having a base metal 1 of nickel as a main composition, an intermediate layer of a rare earth metal oxide of a thickness below 10 $\mu$m or of a rare earth metal of a thickness below 6 $\mu$m formed on a base metal 1, and a thermion emission material layer of an alkaline earth metal oxide containing at least barium Ba formed on the intermediate layer, and, as a third embodiment, a cathode having a base metal 1 of nickel as a main composition added with 0.01–0.5 wt % rare earth metal, and a thermion emission material layer of an alkaline earth metal oxide containing at least barium Ba formed on the base metal 1. In the cathode disclosed in the Korea patent application No. 86-5652, powder of the rare earth metal oxide in the thermion emission material layer 3 makes reaction with the alkaline earth metal oxide, for example BaO, to produce a composite oxide of $Ba_3Sc_4O_9$ or $Ba_3Y_4O_4$. It is supposed that the composite oxide scattered in the thermion emission material layer 3 decomposes at a working temperature of the cathode and makes production of free barium easy, allowing presence of adequate barium, and a portion of the rare earth metal in the composite oxide, freed and scattered in the thermion emission material layer 3, increases a conductivity of the thermion emission material layer 3, that compensates for the resistance of the interface layer. It is described that the cathode in the Korea patent application No. 86-5652 has an advantage in that an electron emission concentration approx. 2–3 times is obtainable compared to a related art cathode of an alkaline earth metal oxide due to less degradation during the lifetime under a high current concentration.

However, the cathode in the Korea patent application No. 86-5652 has problems in that the electron emission current concentration can not be improved any further and has difficulty in fabrication due to complicate process coming from a high temperature heat treatment of the rare earth metal oxide at a temperature over 800° C. in a reducing ambient before the rare earth metal oxide is mixed with the alkaline earth metal oxide.

SUMMARY OF THE INVENTION

Accordingly, the present invention is directed to a cathode in an electron tube that substantially obviates one or more of the problems due to limitations and disadvantages of the related art.

An object of the present invention is to provide a cathode in an electron tube, which can improve electron emission performance, significantly.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the cathode in an electron tube includes an actinoid metal or actinoid metal compound added to either a thermion emission material layer or a base metal, or formed between the thermion emission material layer and the base metal, whereby improving an electron emission characteristic of the cathode, significantly.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings.

Figure 2:
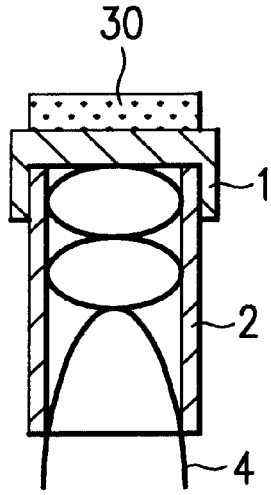
FIG. 2 illustrates a section of a cathode structure in accordance with a first embodiment of the present invention.

Referring to FIG. 2, the cathode in accordance with a first embodiment of the present invention includes a base metal 1 of nickel as a main composition, and a thermion emission material layer 30 formed on the base metal 1, of a alkaline earth metal oxide containing at least barium Ba as a main composition added with at least one of actinoid metals or actinoid metal oxides.

Figure 6:
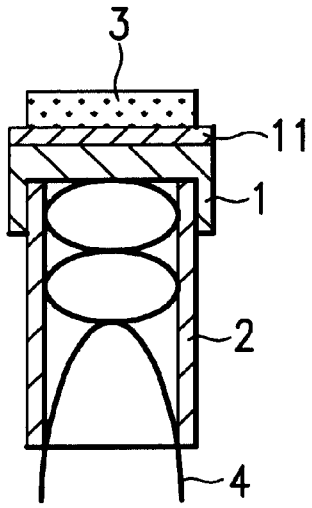
FIG. 6 illustrates a section of a cathode structure in accordance with a second embodiment of the present invention.

Referring to FIG. 6, the cathode in accordance with a second embodiment of the present invention includes a base metal 1 of nickel as a main composition, a clad layer 11 on the base metal, of an actinoid metal or an actinoid metal oxide, and a thermion emission material layer 3 on the clad layer, of a alkaline earth metal oxide containing at least barium Ba.

Figure 7:
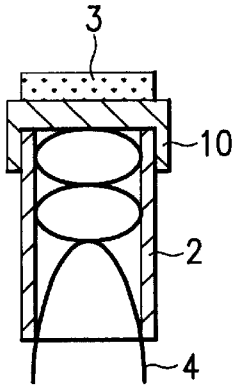
FIG. 7 illustrates a section of a cathode structure in accordance with a third embodiment of the present invention.

Referring to FIG. 7, the cathode in accordance with a third embodiment of the present invention includes a base metal 10 of nickel as a main composition added with a actinoid metal, and a thermion emission material layer 3 on the base metal, of a alkaline earth metal oxide containing at least barium Ba.

The cathode in accordance with the first embodiment of the present invention may include a thermion emission material layer 30 on the base metal 1, of a alkaline earth metal oxide containing at least barium Ba added with strontium or calcium and at least one of actinoid metals or actinoid metal oxides. The aforementioned cathode can be fabricated according to the following process.

A desired wt % of an actinoid metal or actinoid metal compound is added to carbonates of barium Ba, strontium Sr, and calcium Ca(a weight % after the three carbonates are altered into oxides) and mixed, and nitrocellulose solution and butyl acetate are added to the mixture, to prepare a suspension. The suspension is sprayed on a base metal 1 of nickel as main composition to a thickness of approx. 60–80 $\mu$m, then, alike the process of the related art, heated by a heater 4 to alter the alkaline earth metal carbonates into alkaline earth metal oxides and to reduce a portion thereof, to activate. According to the aforementioned method, a cathode having thermion emission material layer 30 containing various actinoid metals or actinoid metal compounds can be fabricated, and the actinoid metals or actinoid metal compounds are not heat treated for reduction before added to, and mixed with the alkaline metal oxide. In the addition and mix of the actinoid metal compounds, since no effect can be expected, on the contrary, if halogen elements are contained, which substantially affect to a degradation of the thermion emission, an actinoid compound of at least one of actinium Ac, thorium Th, and protoactium Pa, containing at least one of nitrogen N, oxygen O, hydrogen H, and carbon C should be used. For example, it would be adequate if the actinoid metal compound contains an actinoid metal and at least one compound of oxide(O), nitric acid(NO), nitride(N), hydroxide(OH), hyperoxide($CH_3COO$), such as Ac(½O, $NO_3$, OH, $CH_3COO)_3$, Th(½O, $NO_3$, OH, $CH_3COO)_4$, Pa(½O, $NO_3$, OH, $CH_3COO)_3$, Pa(½O, $NO_3$, OH, $CH_3COO)_4$, Pa(½O, $NO_3$, OH, $CH_3COO)_5$, Ac(½O, $NO_3$, OH, $CH_3COO)_3.xH_2O$, Th(½O, $NO_3$, OH, $CH_3COO)_4.xH_2O$, and Pa(½O, $NO_3$, OH, $CH_3COO)_5.xH_2O$. The thermion emission material layer 30 in the first embodiment of the present invention contains a 0.0005–15 wt % of actinoid metal or 0.001–20 wt % of actinoid compound.

It is supposed that the first embodiment cathode of the present invention has a good thermion emission performance due to the following reasons.

(1) Though the related art cathode having the thermion emission material layer 3 of alkaline earth metal oxide produces free barium exclusively depending on a reducing reaction of the small amount of reducing elements, such as silicon Si or magnesium Mg in the base metal 1, the cathode in the first embodiment of the present invention produces free barium Ba additionally depending on chemical reaction of an actinoid metal, or actinoid metal compound, for example, thorium nitrate($Th(NO_3)_4$), thereby presenting adequate barium Ba in the first embodiment cathode of the present invention even if the interface layer of the reaction substance explained above impedes the reducing reaction.

(2) Actinoid metal freed from the actinoid metal or actinoid metal compound in the thermion emission material layer 30 of the cathode of the present invention increases a conductivity of the thermion emission material layer 30 and reduces an influence from the resistance of the interface layer.

According to EPMA of the related art cathode which has the base metal 1 of nickel as a main composition added with a small amount of reducing element, such as silicon Si or magnesium Mg and a thermion emission material layer 3 on the base metal 1, of alkaline earth metal oxide after a long time and high current use, it is reported that barium Ba, a thermion emission substance, is observed at a position up to approx. 5 $\mu$m toward the base metal 1 from the interface between the base metal 1 and the thermion emission material layer 3, and silicon Si is observed at a position up to approx. 13 $\mu$m toward the thermion emission material layer 3 from the interface. In detail, in the related art cathode, it is shown that Ba2SiO4, SiO2, MgO, and the composites in the interface layer, which are reaction materials, are produced up to approx. 5 $\mu$m toward the base metal 1 and up to approx. 13 $\mu$m toward the thermion emission material layer 3. The oxides and the composites of the oxides in the interface layer, reaction materials, impede diffusion of the reducing elements in the base metal 1 and impede a current flow to a high resistance layer.

It is supposed that the actinoid metal or actinoid metal compound in the cathode of the present invention reduces a chemical reaction producing the interface layer during working of the cathode. It is supposed that the chemical reaction made in the cathode of the present invention is between the actinoid metal or actinoid metal compound, such as thorium nitrate ($Th(NO_3)_4$) in the thermion emission material layer 30 and the alkaline earth metal oxide, such as BaO, as follows.

Chemical Equation 1(regular reaction without $Th(NO_3)_4$)

$$4BaO+Si(\text{in base metal})=2Ba+Ba_2Si_4(\text{reaction material}),\ BaO+Mg(\text{in base metal})=Ba+MgO(\text{reaction material}),\ Ba=Ba^{2+}+2e^-(\text{electron emission}).$$

Chemical Equation 2(decomposition of barium oxide by thorium nitrate)

$$2BaO+Th(NO_3)_4=2Ba+ThO_2+4NO_2(Gas)+2O_2(Gas),\ Ba=Ba^{2+}+2e^-(\text{electron emission}).$$

Chemical Equation 3(decomposition of reaction material by thorium nitrate)

$$Ba_2SiO_4(\text{reaction material})+Th(NO_3)_4=2Ba+Si+ThO_2+4NO_2(Gas)+2O_2(Gas,\ Ba=Ba^{2+}+2e^-(\text{electron emission}).$$

In the first embodiment cathode of the present invention, though an addition of 1 wt % more of the reducing metal to the thermion emission material layer 30 enhances a chemical reaction between the reducing metal and the alkaline earth metal oxide, to suppress the reaction materials of oxides in the interface layer between the base metal 1 and the thermion emission material layer 30 and help the high current emission, an excessive addition of the reducing metal over the additional 1 wt % to the thermion emission material layer 30 causes an excessive reducing reaction, with an excessive production of the barium Ba, which shortens a lifetime of the cathode. The reducing material includes at least one of Ni, Si, Mg, Fe, Ti, Hf, V, Nb, Ta, Al, Cu, Zn, Cr, Mo, W, Zr, and Co.

Figure 3:
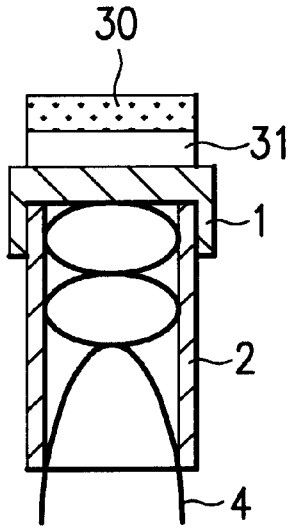
FIG. 3 illustrates a section of another cathode structure in accordance with a first embodiment of the present invention.

Referring to FIG. 3, another cathode in accordance with a first embodiment of the present invention includes a base metal 1, a thermion emission material layer 30 of a alkaline earth metal oxide as a main composition containing at least barium added with at least one of an actinoid metal or an actinoid metal oxide, and a second thermion emission material layer 31 of alkaline earth metal oxide containing at least barium disposed between the base metal 1 and the thermion emission material layer 30. This another cathode in accordance with a first embodiment of the present invention is effective in weakening the reducing action of the actinoid metal or actinoid metal compound at an initial stage and in obtaining a stable current of a higher emission current concentration during a lifetime of working. It is effective that the second thermion emission material layer is to have a thickness of 10–70 $\mu$m.

Figure 4:
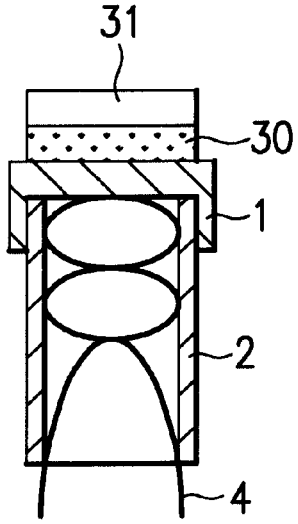
FIG. 4 illustrates a section of further another cathode structure in accordance with a first embodiment of the present invention.

Referring to FIG. 4, a further another cathode in accordance with a first embodiment of the present invention further includes a second thermion emission material layer 31 of alkaline earth metal oxide containing at least barium on the thermion emission material layer 30 on the base metal 1 of the first embodiment of the present invention shown in FIG. 2. This further another cathode in accordance with a first embodiment of the present invention restricts an excessive production of barium at an initial stage and during working lifetime coming from the reducing action of the actinoid metal or actinoid metal compound by means of the second thermion emission material layer, to restrict vaporization of barium during working, for obtaining a stable thermion emission characteristic in the initial stage and during the working lifetime. It is effective that the second thermion emission material layer is to have a thickness of 10–70 $\mu$m.

Figure 5:
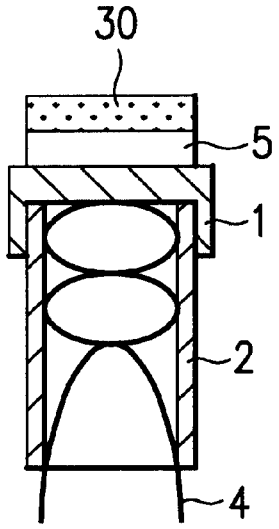
FIG. 5 illustrates a section of still another cathode structure in accordance with a first embodiment of the present invention.

Referring to FIG. 5, a still another cathode in accordance with the first embodiment of the present invention includes the base metal 1, a surface layer 5 of reducing metals containing at least one of Ni, Si, Mg, Fe, Ti, Hf, V, Nb, Ta, Al, Cu, Zn, Cr, Mo, W, Zr and Co, and the thermion emission material layer 30 of the present invention. The surface layer 5 suppresses the reaction material of the interface layer by enhancing the reducing action of the alkaline earth metal oxide, for preventing drop of a conductivity. The surface layer 5 of reducing metals in the cathode of the present invention is preferably sputtered to a thickness below 10 $\mu$m for being porous. A thickness of the surface layer in excess of the 10 $\mu$m leads to a low porosity of the surface layer, which causes, not to produce oxides, reaction materials between the reducing metals in the base metal 1 and the alkaline earth metal oxides in the thermion emission material layer 30, but only to make reaction between the reducing metal in the surface layer and the alkaline earth metal oxide, to peel off of the thermion emission material layer 30 from the base metal 1, so called peel off of the thermion emission material layer 30.

Referring to FIG. 6, the cathode in accordance with a second embodiment of the present invention includes a base metal 1 of nickel as a main composition, a clad layer 11 on the base metal, of an actinoid metal or an actinoid metal oxide, and a thermion emission material layer 3 on the clad layer, of a alkaline earth metal oxide containing at least barium Ba. It is supposed that the cathode in accordance with the second embodiment of the present invention has advantages in that a degradation of the base metal 1 and the peel off of the clad layer 11 are prevented due to diffusion of the clad layer 11 of an actinoid metal or an actinoid metal compound into the base metal 1 and the thermion emission material layer 3, which strengthens bonding between the base metal 1 and the clad layer 11 and in that the advantages of the first embodiment of the present invention is obtained from the thermion emission material layer 3. The thermion emission material layer 3 on the clad layer 11 on the base metal 1 in the cathode of the second embodiment of the present invention is formed of alkaline earth metal oxides containing at least barium added with strontium Sr or calcium Ca. The actinoid in the cathode of the second embodiment of the present invention includes at least one of actinium Ac, thorium Th, and protoactinium Pa, and the actinoid metal compound includes a compound containing at least one of actinium Ac, thorium Th, and protoactinium Pa. The cathode of the second embodiment of the present invention can be fabricated by forming the clad layer 11 of the actinoid metal or the actinoid metal compound on the base metal 1 by an electron beam or sputtering before the thermion emission material layer 3 of alkaline earth metal oxide containing at least barium is formed on the base metal 1. The actinoid metal compound of the second embodiment of the present invention is preferably an actinoid metal oxide containing at least one of $Ac_2O_3$, $Th_2O_3$, $ThO_2$, $Pa_2O_3$, $PaO_2$, and $Pa_2O_5$. In the cathode of the second embodiment of the present invention, a reducing metal may be further included to the actinoid metal or the actinoid metal compound in the clad layer 11 to obtain the aforementioned advantages. The reducing metal includes at least one of Ni, Si, Mg, Fe, Ti, Hf, V, Nb, Ta, Al, Cu, Zn, Cr, Mo, W, Zr and Co. As has been explained, in order to be effective, the thickness of the clad layer 11 in cathode of the second embodiment of the present invention should be below 10 $\mu$m for being porous in the case of actinoid metal oxide, and a thickness in excess of 6 $\mu$m in the case of actinoid metal drops the effect.

Referring to FIG. 7, the cathode in accordance with a third embodiment of the present invention includes a base metal 10 of nickel as a main composition added with a actinoid metal, and a thermion emission material layer 3 on the base metal 10, of a alkaline earth metal oxide containing at least barium Ba. The thermion emission material layer 3 on the base metal 10 in the cathode of the third embodiment of the present invention is formed of alkaline earth metal oxides containing at least barium added with strontium Sr or calcium Ca. The actinoid in the cathode of the third embodiment of the present invention includes at least one of actinium Ac, thorium Th, and protoactinium Pa. In the cathode of the third embodiment of the present invention, a reducing metal may be further included to the actinoid metal in the base metal 10 to obtain the aforementioned advantages. The reducing metal includes at least one of Ni, Si, Mg, Fe, Ti, Hf, V, Nb, Ta, Al, Cu, Zn, Cr, Mo, W, Zr and Co. In the cathode of the third embodiment of the present invention, though even a small amount addition of actinoid metal gives a good effect, an amount of 0.0005–0.5 wt % of the actinoid metal is appropriate. An addition of the actinoid metal below 0.0005 wt % can not provide an adequate suppression of production of the interface layer, a reaction material of the base metal 11 and the thermion emission material 3, and an addition of the actinoid metal in excess of 0.5 wt % results in production of excessive barium, which is not effective, too.

Effects of the cathode of the present invention will be explained.

Figure 1:
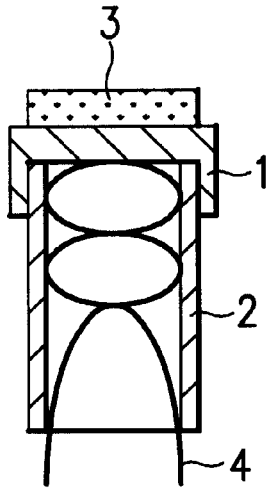
FIG.1 Prior Art
FIG. 1 illustrates a section of a related art cathode structure.
Figure 8:
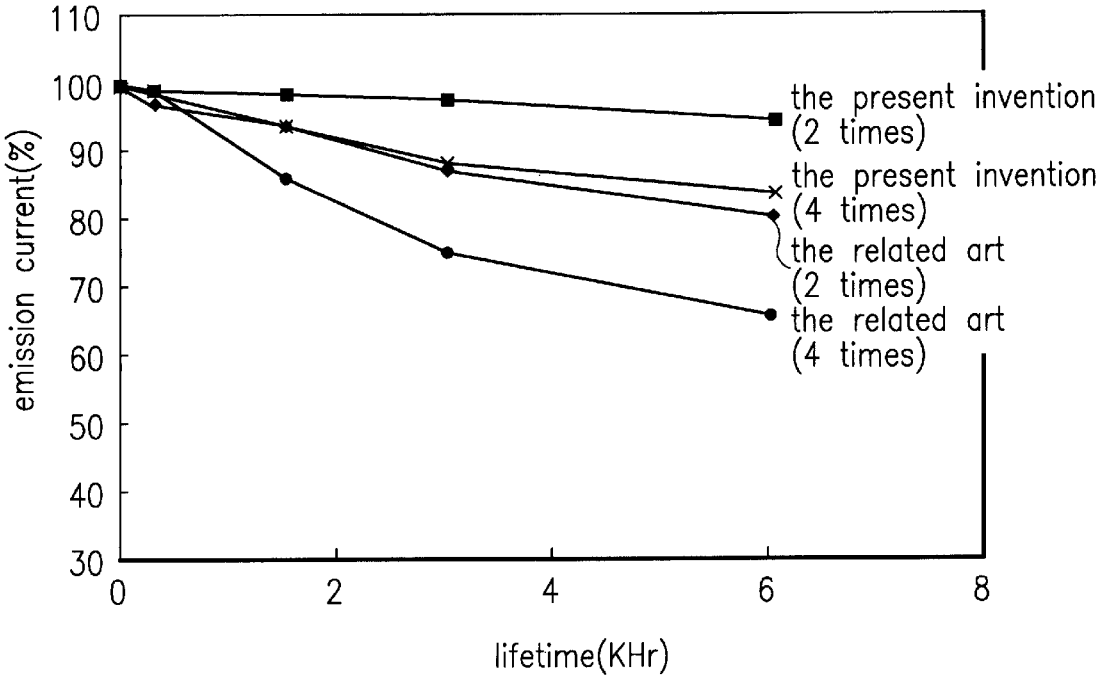
FIG. 8 illustrates a graph showing changes of emission current for 6000 hours of lifetime of cathodes.
Figure 9:
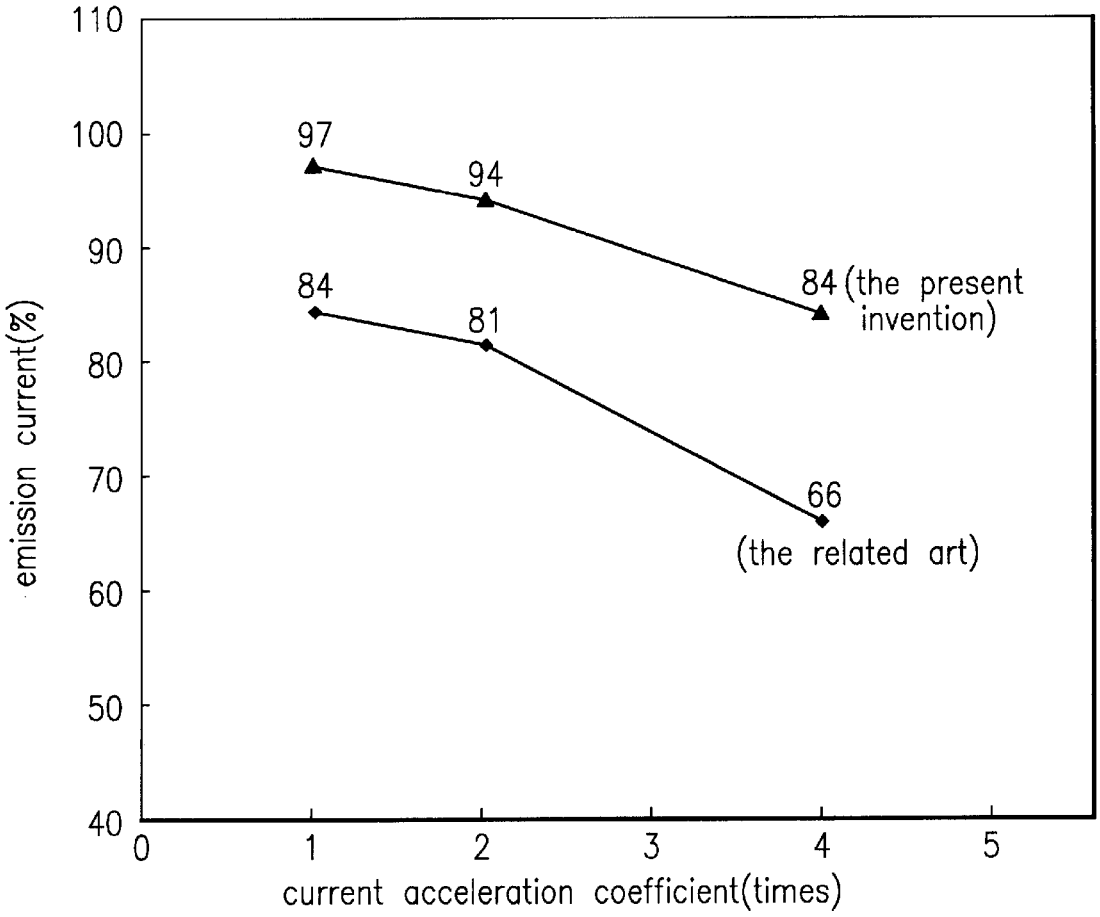
FIG. 9 illustrates a graph showing current acceleration coefficient vs. emission current after use of cathodes for 6000 hours of lifetime under a regular working temperature of the cathode.
Figure 10:
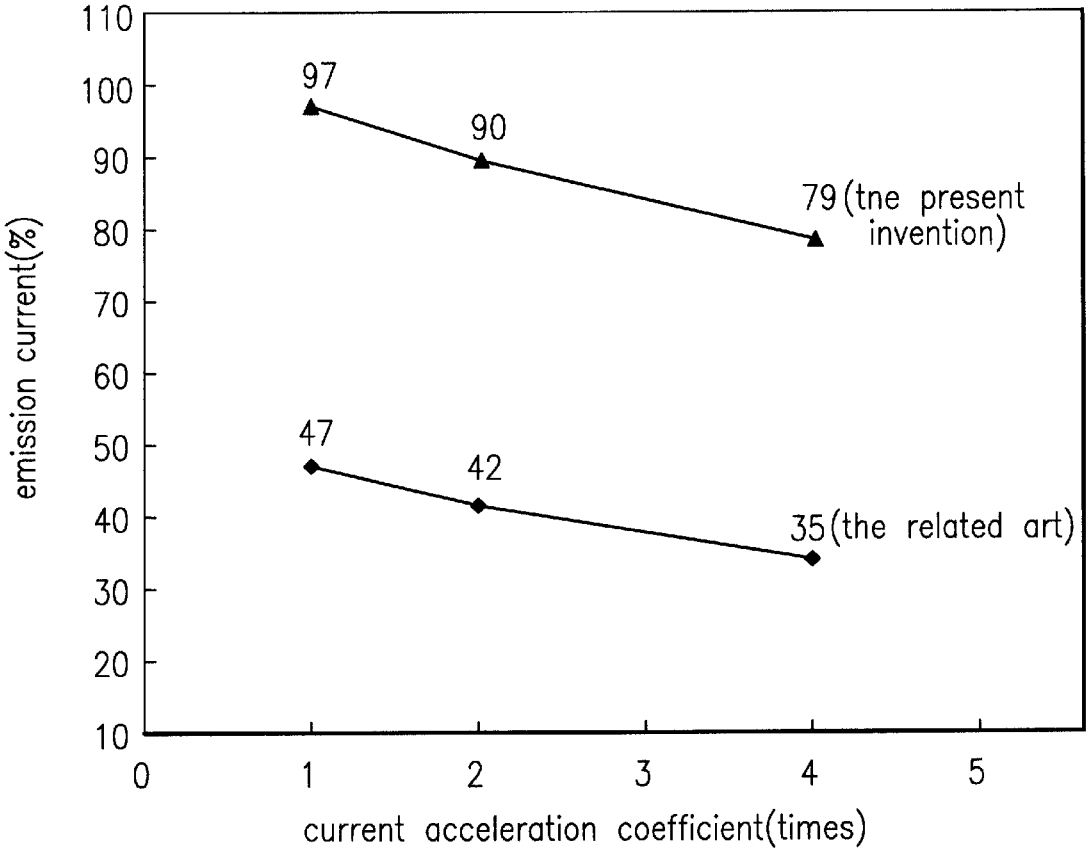
FIG. 10 illustrates a graph showing current acceleration coefficient vs. emission current after use of cathodes for 6000 hours of lifetime under a temperature lower than the regular working temperature of the cathode; and, FIG. 11 illustrates an analysis showing a thermal decomposition of a cathode having a related art thermion emission material layer.
Figure 11:
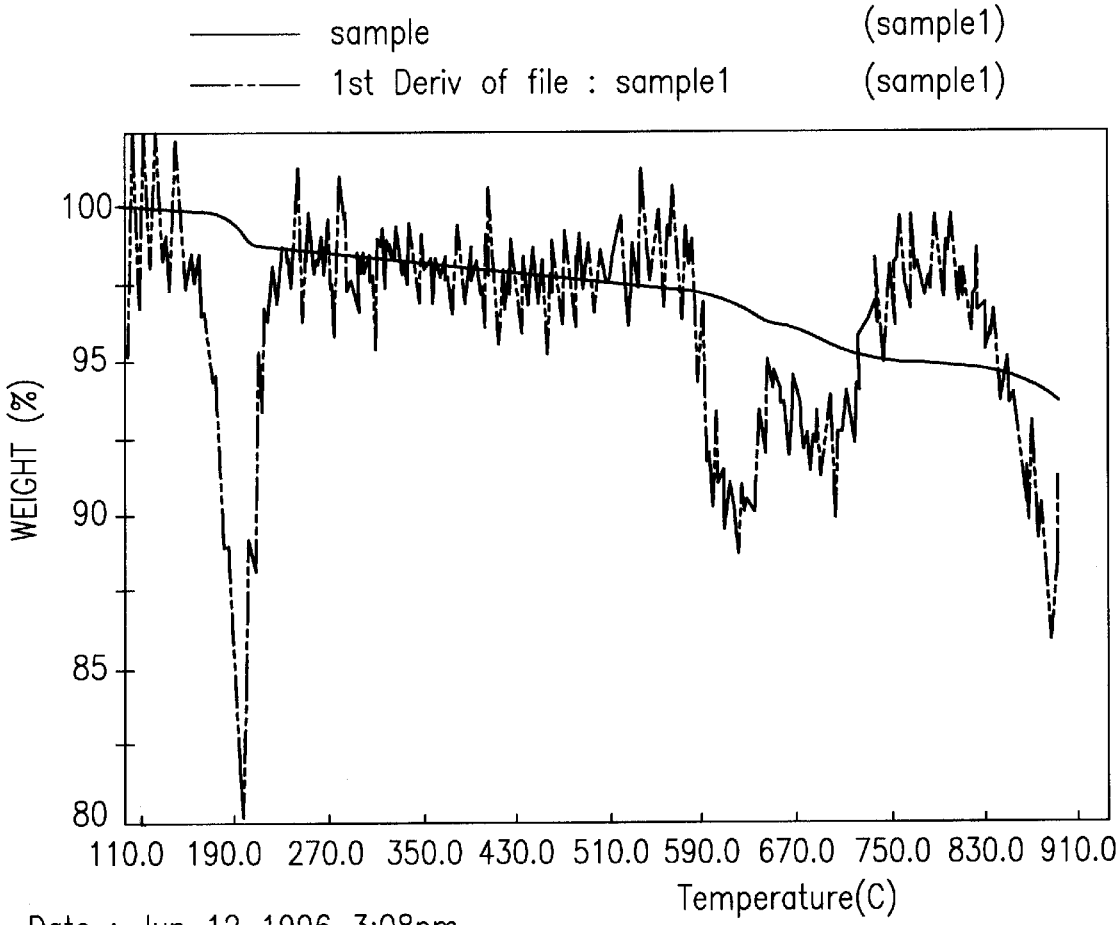

6000 hour current accelerated life time tests are conducted on the related art cathode with the thermion emission material layer 3 of an alkaline earth metal oxide and the cathode 30 of the present invention with the thermion emission material layer 30 of alkaline earth metal oxide added with a 0.3 wt % $Th(NO_3)_4$. Emission current vs. life time are plotted while the current is accelerated using a monitor cathode ray tube to two and four times with reference to a current of the cathode with a thermion emission material layer of a alkaline earth metal oxide. As a result, as shown in FIG. 8, it is found that the cathode of the present invention with a thermion emission material layer 30 has a less degradation of emission current in comparison to the related art cathode with a thermion emission material layer 3. FIG. 9 illustrates a graph showing current acceleration coefficient vs. emission current after use of cathodes for 6000 hours of lifetime under a regular working temperature of the cathodes of the related art with the thermion emission material layer 3 and of the present invention with the thermion emission material layer 30. As a result, it is found that the cathode of the present invention has an electron emission characteristic equivalent to approx. four times of current acceleration compared to a current of a related art cathode. FIG. 10 illustrates a graph showing current acceleration coefficient vs. emission current after use of cathodes for 6000 hours of lifetime under a temperature lower than the regular working temperature of the cathodes of the related art with thermion emission material and of the thermion emission material of the present invention. As a result, it is found that the cathode of the present invention has a electron emission characteristic excellent compared to the related art cathode. FIG. 11 illustrates an analysis showing a thermal decomposition of a related art thermion emission material layer 3 of the related art with an alkaline earth metal oxide using TGA, wherein an ordinate represents a weight % of the thermion emission material layer remained after thermal decomposition with reference to a basic weight and an abscissa represents a temperature of the thermal decomposition. As shown in FIG. 11, approx. 700–800° C. would be adequate as a regular working temperature of the related art cathode at which no thermal decomposition occurs and a stable current can be obtained, and it is important that the emission current is observed at a low temperature of the cathode to obtain a stable current as there is an intensive thermal decomposition occurred at approx. 570–700° C. Though an intensive thermal decomposition is observed at approx. 210° C. in FIG. 11, those are thermal decompositions of the aforementioned nitrocellulose solution and butyl-acetate. A thermal decomposition temperature of the thermion emission material layer in the cathode of the present invention is the same with the related art cathode. As shown in FIG. 1, the $CO_2$, a main product in the thermal decomposition process of the alkaline earth metal carbonates into alkaline earth metal oxides at the low cathode temperature, degrades the electron emission during the life time. However, as shown in FIG. 10, it is understood that the excellent emission current of the cathode of the present invention after the life time test at the low cathode temperature indicates that the cathode of the present invention is very strong against the $CO_2$ gas. Particularly, it is understood that the reason the electron emission characteristic of the cathode of the present invention is excellent than that of the cathode disclosed in Korea patent application No. 86-5652 is that the cathode of the present invention has a characteristic stronger than the related art. Though not shown in FIGS. 8 and 9, the cathode containing the actinoid metal shows an effect the same with the cathode containing the actinoid metal compound.

As has been explained, the actinoid metal or the actinoid metal compound in the cathode in an electron tube of the present invention added to either the thermion emission material layer or base metal, or formed between the thermion emission material layer and the base metal allows to obtain a cathode of which electron emission characteristic is improved, significantly.

It will be apparent to those skilled in the art that various modifications and variations can be made in the cathode in an electron tube of the present invention without departing from the spirit or scope of the invention. Thus, it is intended that the present invention cover the modifications and variations of this invention provided they come within the scope of the appended claims and their equivalents.

What is claimed is:

1. A cathode in an electron tube comprising:

a base metal of nickel as a main composition; and, a thermion emission material layer of an alkaline earth metal oxide containing at least barium as a main composition added with at least one of actinoid metals or actinoid metal compounds, the thermion emission material layer formed on the base metal.

2. A cathode as claimed in claim 1, wherein the thermion emission material layer contains a 0.0005–15 wt % actinoid metal.

3. A cathode as claimed in claim 1, wherein the thermion emission material layer contains a 0.001–20 wt % actinoid metal oxide.

4. A cathode as claimed in claim 1, wherein the alkaline earth metal oxide contains other alkaline earth metal other than barium.

5. A cathode as claimed in claim 4, wherein the alkaline earth metal includes at least either of strontium and calcium other than barium.

6. A cathode as claimed in claim 1, wherein the actinoid metal includes at least one of actinium Ac, thorium Th, and protoactinium Pa.

7. A cathode as claimed in claim 1, wherein the actinoid metal compound includes a compound containing at least one of actinium Ac, thorium Th, and protoactinium Pa.

8. A cathode as claimed in claim 7, wherein the actinoid metal compound includes a compound containing an actinoid metal and at least one of nitrogen N, oxygen O, hydrogen H, and carbon C.

9. A cathode as claimed in claim 8, wherein the actinoid metal compound of nitrogen N, oxygen O, hydrogen H, and carbon C includes at least one compound of oxide(O), nitric acid(NO), nitride(N), hydroxide(OH), and hyperoxide ($CH_3COO$).

10. A cathode as claimed in claim 9, wherein the actinoid metal compounds of the oxide(O), nitric acid(NO), nitride (N), hydroxide(OH), and hyperoxide($CH_3COO$) includes at least one of Ac(½O, $NO_3$, OH, $CH_3COO)_3$, Th(½O, $NO_3$, OH, $CH_3COO)_4$, Pa(½O, $NO_3$, OH, $CH_3COO)_3$, Pa(½O, $NO_3$, OH, $CH_3COO)_4$, Pa(½O, $NO_3$, OH, $CH_3COO)_5$, Ac(½O, $NO_3$, OH, $CH_3COO)_3.xH_2O$, Th(½O, $NO_3$, OH, $CH_3COO)_4.xH_2O$, and Pa(½O, $NO_3$, OH, $CH_3COO)_5.xH_2O$.

11. A cathode as claimed in claim 1, wherein the thermion emission material layer further includes a reducing metal.

12. A cathode as claimed in claim 11, wherein the reducing metal is below 1 wt %.

13. A cathode as claimed in claim 11, wherein the reducing metal includes at least one of Ni, Si, MO, Fe, Ti, Hf, V, Nb, Ta, Al, Cu, Zn, Cr, Mo, W, Zr, and Co.

14. A cathode as claimed in claim 1, further comprising a reducing metal layer between the base metal and the thermion emission material layer.

15. A cathode as claimed in claim 14, wherein a surface layer of the reducing metal is sputtered on the base metal.

16. A cathode as claimed in claim 14, wherein the reducing metal layer has a thickness below 10 $\mu$m.

17. A cathode as claimed in claim 14, wherein the reducing metal includes at least one of Ni, Si, Mg, Fe, Ti, Hf, V, Nb, Ta, Al, Cu, Zn, Cr, Mo, W, Zr, and Co.

18. A cathode as claimed in claim 1, wherein the thermion emission material layer includes a coat of suspension on the base metal, of an alkaline earth metal carbonate containing at least barium added with an actinoid metal or actinoid metal compound.

19. A cathode as claimed in claim 1, further comprising a second thermion emission material layer of an alkaline earth metal oxide containing at least barium between the base metal and the thermion emission material layer.

20. A cathode as claimed in claim 19, wherein the second thermion emission material layer has a thickness of 10~70 $\mu$m.

21. A cathode as claimed in claim 1, further comprising a second thermion emission material layer of an alkaline earth metal oxide containing at least barium on the thermion emission material layer.

22. A cathode as claimed in claim 21, wherein the second thermion emission material layer has a thickness of 10~70 $\mu$m.

23. A cathode in an electron tube comprising:

a base metal of nickel as a main composition;

a clad layer on the base metal, of actinoid metal or actinoid metal compound; and, a thermion emission material layer on the clad layer, of an alkaline earth metal oxide containing at least barium.

24. A cathode in an electron tube as claimed in claim 23, wherein the surface layer of the actinoid metal has a thickness below 6 $\mu$m.

25. A cathode in an electron tube as claimed in claim 23, wherein the surface layer of the actinoid metal compound has a thickness below 10 $\mu$m.

26. A cathode in an electron tube as claimed in claim 23, wherein the alkaline earth metal oxide contains at least barium Ba, added with at least one of strontium Sr and calcium.

27. A cathode in an electron tube as claimed in claim 23, wherein the actinoid metal includes at least one of actinium Ac, thorium Th, and protoactinium Pa.

28. A cathode in an electron tube as claimed in claim 23, wherein the actinoid metal compound includes at least a compound of actinium Ac, thorium Th, and protoactinium Pa.

29. A cathode in an electron tube as claimed in claim 28, wherein the actinoid metal compound is an actinoid metal oxide.

30. A cathode in an electron tube as claimed in claim 29, wherein the actinoid metal oxide includes at least one of $Ac_2O_3$, $Th_2O_3$, $ThO_2$, $Pa_2O_3$, $PaO_2$, and $Pa_2O_5$.

31. A cathode in an electron tube as claimed in claim 29, wherein the actinoid metal or the actinoid metal oxide is added with a reducing metal.

32. A cathode as claimed in claim 31, wherein the reducing metal includes at least one of Ni, Si, Mg, Fe, Ti, Hf, V, Nb, Ta, Al, Cu, Zn, Cr, Mo, W, Zr, and Co.

33. A cathode as claimed in claim 23, wherein the surface layer is formed by an electron beam method or a sputtering method.

34. A cathode in an electron tube comprising:

a base metal of nickel as a main composition added with an actinoid metal; and, a thermion emission material layer on the base metal, of an alkaline earth metal oxide containing at least barium.

35. A cathode in an electron tube as claimed in claim 34, wherein the base metal includes a 0.0005–0.5 wt % of actinoid metal.

36. A cathode in an electron tube as claimed in claim 34, wherein the alkaline earth oxide contains at least barium added with at least one of strontium Sr and calcium Ca.

37. A cathode in an electron tube as claimed in claim 34, wherein the actinoid metal includes at least one of actinium Ac, thorium Th, and protoactinium Pa.

38. A cathode in an electron tube as claimed in claim 34, wherein the base metal further includes a reducing metal.

39. A cathode in an electron tube as claimed in claim 38, wherein the reducing metal includes at least one of Ni, Si, Mg, Fe, Ti, Hf, V, Nb, Ta, Al, Cu, Zn, Cr, Mo, W, Zr, and Co.

* * * * *